US009397423B2

(12) United States Patent
Suzuki et al.

(10) Patent No.: US 9,397,423 B2
(45) Date of Patent: Jul. 19, 2016

(54) BOARD-TO-BOARD CONNECTOR

(71) Applicant: Molex, LLC, Lisle, IL (US)

(72) Inventors: Toru Suzuki, Yamato (JP); Taichi Taniguchi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/476,932

(22) Filed: Sep. 4, 2014

(65) Prior Publication Data

US 2015/0079816 A1 Mar. 19, 2015

(30) Foreign Application Priority Data

Sep. 4, 2013 (JP) ..... 2013-182700

(51) Int. Cl.

| | |
|---|---|
| ***H01R 12/73*** | (2011.01) |
| ***H01R 12/71*** | (2011.01) |
| ***H01R 12/70*** | (2011.01) |
| ***H01R 13/627*** | (2006.01) |

(52) U.S. Cl.

CPC ..... *H01R 12/716* (2013.01); *H01R 12/7082* (2013.01); *H01R 13/6275* (2013.01); *H01R 12/73* (2013.01)

(58) Field of Classification Search

CPC ..... H01R 12/716; H01R 12/7082; H01R 13/6275; H01R 12/73; H01R 23/725; H01R 9/096

USPC ..... 439/74, 66, 91, 591, 65, 660

See application file for complete search history.

(56) References Cited

U.S. PATENT DOCUMENTS

| | | | | | |
|---|---|---|---|---|---|
| 5,120,256 | A * | 6/1992 | Walden | H01R 12/707 | 439/553 |
| 6,132,258 | A * | 10/2000 | Kajinuma | H01R 12/707 | 439/108 |
| 6,645,005 | B2 * | 11/2003 | Wu | H01R 12/707 | 439/563 |
| 7,128,581 | B2 | 10/2006 | Igarashi et al. | | |
| 7,384,274 | B1 * | 6/2008 | Chen | H01R 12/714 | 439/74 |
| 7,901,218 | B2 | 3/2011 | Sato et al. | | |
| 8,845,339 | B2 * | 9/2014 | Ono | H01R 12/7052 | 439/74 |
| 9,124,011 | B2 * | 9/2015 | Miyazaki | H01R 12/716 | 439/74 |
| 9,225,086 | B2 | 12/2015 | Takeuchi et al. | | |
| 2008/0207014 | A1 * | 8/2008 | Takeuchi | H01R 13/6275 | 439/74 |
| 2010/0068900 | A1 * | 3/2010 | Wu | H01R 12/716 | 439/74 |
| 2010/0081330 | A1 * | 4/2010 | Wu | H01R 12/716 | 439/626 |
| 2012/0231637 | A1 * | 9/2012 | Takeuchi | H01R 12/716 | 439/65 |
| 2013/0330943 | A1 * | 12/2013 | Sasaki | H01R 13/631 | 439/74 |
| 2013/0330970 | A1 | 12/2013 | Hirata | | |

* cited by examiner

*Primary Examiner* — Abdullah Riyami
*Assistant Examiner* — Harshad Patel
(74) *Attorney, Agent, or Firm* — James A. O'Malley

(57) ABSTRACT

A first connector is equipped with a first terminal, a first housing and a first reinforcing bracket. The he first reinforcing bracket is equipped with a band-like first main body portion extending in the lateral direction of the first housing. A first arm portion held by the first housing. The first main body is equipped with a pair of bent portions connected to both ends of a central portion and formed in a crank-shape when viewed from the direction of insertion and extraction to increase the torsional stiffness. A first locking portion is formed in the central portion. A cover portion is bent towards the upper end of the central portion via a rounded portion to increase the torsional stiffness of the central portion, and to protect the outer wall portion of the first housing.

16 Claims, 4 Drawing Sheets

BOARD-TO-BOARD CONNECTOR

REFERENCE TO RELATED APPLICATIONS

The Present Disclosure claims priority to prior-filed Japanese Patent Application No. 2013-182700, entitled "Board-To-Board Connector," and filed with the Japanese Patent Office on 4 Sep. 2013. The content of the aforementioned Application is fully incorporated herein in its entirety.

BACKGROUND OF THE PRESENT DISCLOSURE

The Present Disclosure relates, generally, to board-to-board connectors.

Conventional board-to-board connectors are used to electrically connect a pair of parallel circuit boards. These connectors are mounted on the surfaces of the pair of circuit boards facing each other, and then mated to establish an electrical connection. The reinforcing brackets have been proposed which are mounted on both ends to function as locking members for keeping the two connectors mated. An example of such a connector is disclosed in Japanese Patent Application No. 2002-210189, the content of which is hereby incorporated herein in its entirety.

FIGS. 8(*a*) and 8(*b*) are a perspective view showing reinforcing brackets for conventional board-to-board connectors. In FIG. 8(*b*), 811 is a first housing for a first connector mounted on a first circuit board (not shown). In FIG. 8(*a*), 911 is a second housing for a second connector mounted on a second circuit board (not shown). A plurality of first terminals (not shown) are provided in the first housing 811, and a plurality of second terminals (not shown) are provided in the second housing 911. When the first connector and the second connector are mated, the opposing first and second terminals make contact with each other, and an electrical connection is established between the first circuit board and the second circuit board.

A groove-shaped first bracket accommodating recess 826 is formed on both ends of the first housing 811 in the longitudinal direction, and the first reinforcing bracket 851 is forcibly inserted into the first bracket accommodating recess 826 and mounted. The first reinforcing bracket 851 is an integrally formed metal sheet which has been stamped and bent, and includes a main body portion 852, a securing arm portion 856 extending downward from both ends of the main body portion 852 and soldered to the first circuit board, a pair of protruding pieces 857 extending downward from the main body portion 852, an elastic piece 853 formed between the protruding pieces 857, and a locking protrusion 854 protruding from the inner surface of the elastic piece 853.

Similarly, a second reinforcing bracket 951 is mounted on both the left and right ends of the second housing 911 in the longitudinal direction. The second reinforcing bracket 951 is an integrally formed metal sheet which has been stamped and bent, and includes a main body portion 952, a securing arm portion 956 extending downward from both ends of the main body portion 952 and soldered to the second circuit board, and a locking protrusion 954 protruding outward from the main body portion 952.

When the first connector and the second connector are mated, the locking protrusion 854 on the first reinforcing bracket 851 engages the locking protrusion 954 on the second reinforcing bracket 951. In this way, the first connector and the second connector can be locked and kept in a mated state. Either the first housing 811 or the second housing 911 can be on top during the mating process.

However, in conventional board-to-board connectors, the first reinforcing bracket 851 and/or the second reinforcing bracket 951 is elastically deformed. As a result, the first connector and the second connector cannot be locked using a sufficiently large amount of force even when the locking protrusion 854 on the first reinforcing bracket 851 engages the locking protrusion 954 on the second reinforcing bracket 951. In other words, disengaging force, which is force used to disengage the first connector and the second connector, is applied to the first connector and/or the second connector, torsion is applied to the main body portion 852 of the first reinforcing bracket 851 and/or to the main body portion 952 of the second reinforcing bracket 951, and the locking protrusion 854 on the first reinforcing bracket 851 and the locking protrusion 954 on the second reinforcing bracket 951 are easily disengaged. In the case of the first reinforcing bracket 851, the span between the arm portions 856 formed at both ends of the main body portion 852 is lengthy, which increases the amount of torsional deformation of the central section of the main body portion 852. As a result, displacement of the locking protrusion 854 is increased, and it readily disengages from the locking protrusion 954 of the second reinforcing bracket 951.

Also, in conventional board-to-board connectors, when an attempt is made to mate the first connector and the second connector with the first housing 811 shifted slightly in the longitudinal direction, the second connector comes into contact with the outer wall portion 821 of the first housing 811 which stands upright on the outside of the first reinforcing bracket 851. As a result, the first and second connectors cannot be smoothly mated, a large amount of force is applied to the outer wall portion 821 of the first housing 811, and the outer wall portion 821 may be toppled or break.

SUMMARY OF THE PRESENT DISCLOSURE

Therefore, it is an object of the Present Disclosure to solve these problems by providing board-to-board connectors in which the first connector and the second connector can be smoothly mated, and deformation of and damage to the outer wall portion of the first connector can be prevented, by forming a pair of bent portions and a cover portion on the first reinforcing bracket of the first connector. The synergy between the pair of bent portions and the cover portion can effectively prevent deformation of the first reinforcing bracket. As a result, the first reinforcing bracket of the first connector and the second reinforcing bracket of the second connector are securely engaged and locked, requiring a large disengaging force. This reliably keeps the first connector and the second connector mated. The cover portion formed in the first reinforcing bracket also enables the connectors to be smoothly mated.

In order to achieve this object, the Present Disclosure is a board-to-board connector comprises a substantially rectangular first housing equipped with a first terminal, an insertion recessed portion, and a first protruding end portion surrounding the insertion recessed portion. A first connector has a first reinforcing bracket disposed in the insertion recessed portion. A substantially rectangular second housing is equipped with a second terminal contacting the first terminal and an insertion protruding portion inserted into the insertion recessed portion. A second connector has a second reinforcing bracket disposed in the insertion recessed portion and engages the first reinforcing bracket. The first reinforcing bracket is equipped with a band-like first main body portion extending in the lateral direction of the first housing. A first arm portion connects to both ends of the first main body portion, extends in the longitudinal direction of the first housing, and is held by the first housing. The first main body includes a central portion extends linearly in the lateral direction of the first housing when viewed from the direction of insertion and extraction. A pair of bent portions connects to both ends of the central portion, and is formed in a crank-shape when viewed from the direction of insertion and extraction to increase both the section modulus and the torsional stiffness. A pair of outer end portions extends from the bent portions in the lateral direction of the first housing and connected to the first arm portion. A first locking portion is formed in the central portion. A cover portion extends to the outside in the axial direction of the first housing so as to run across the upper end of the central portion and orthogonal to the central portion to increase the torsional stiffness of the central portion and protect the outer wall portion of the first protruding end portion. The second reinforcing bracket is equipped with a band-like second main body portion extending in the lateral direction of the second housing, and a second locking portion is formed in the second main body portion. The first locking portion is a protruding portion formed in the central portion and protruding towards the second reinforcing bracket, and the second locking portion is a recessed portion or an open portion engaging the first locking portion.

The first arm portion may have a protruding portion provided on the inside surface which comes into contact with the side surface of the first housing. Each insertion recessed portion may be formed at both ends of the first housing in the longitudinal direction, the first reinforcing bracket disposed towards the outside in the longitudinal direction of each insertion recessed portion, each insertion protruding portion formed at both ends of the second housing in the longitudinal direction, and the second reinforcing bracket disposed along the outside end of each insertion protruding portion in the longitudinal direction.

In the Present Disclosure, a pair of bent portions and a cover portion are formed in the first reinforcing bracket of the first connector, and the synergy between the pair of bent portions and the cover portion can effectively prevent deformation of the first reinforcing bracket. As a result, the first reinforcing bracket of the first connector and the second reinforcing bracket of the second connector are securely engaged and locked, requiring a large disengaging force. This reliably keeps the first connector and the second connector mated. The cover portion formed in the first reinforcing bracket also enables the first connector and the second connector to be smoothly mated, and can prevent deformation of and damage to the outer wall portion in the first connector.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
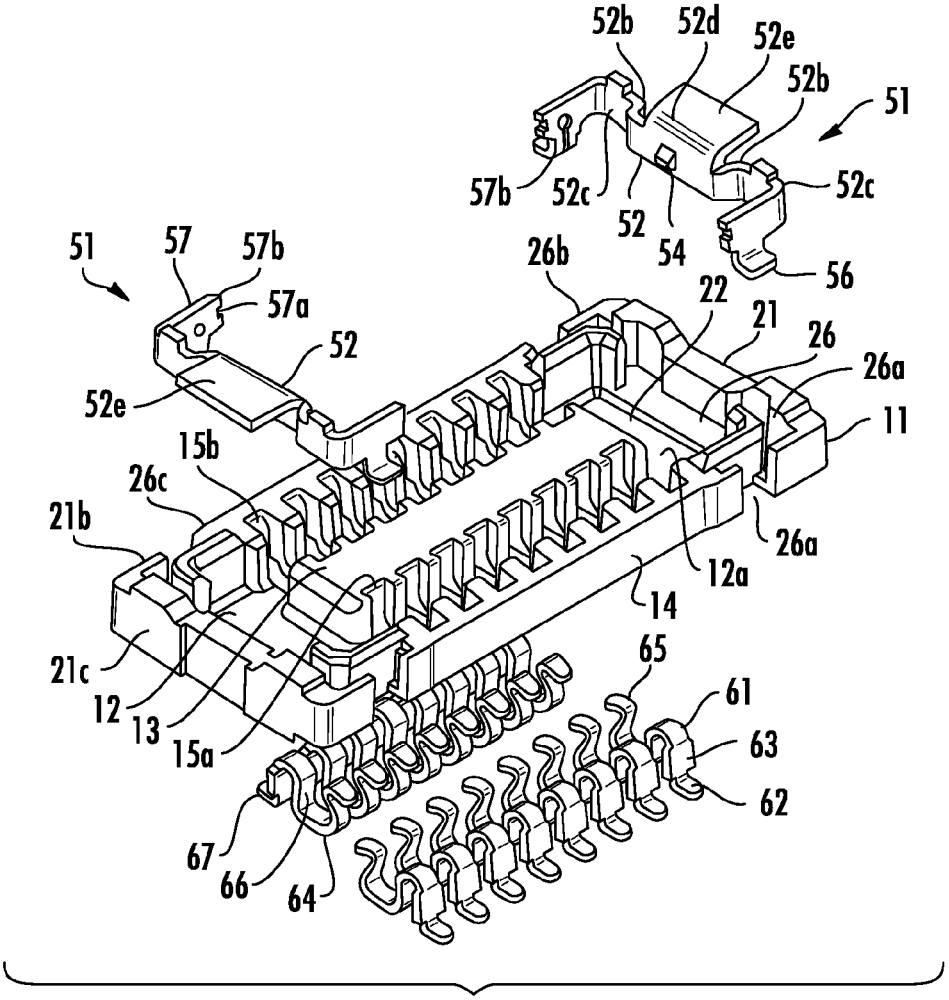
FIG. 1 is an exploded perspective view of the first connector in an embodiment of the Present Disclosure, as viewed from the mating surface.
Figure 2:
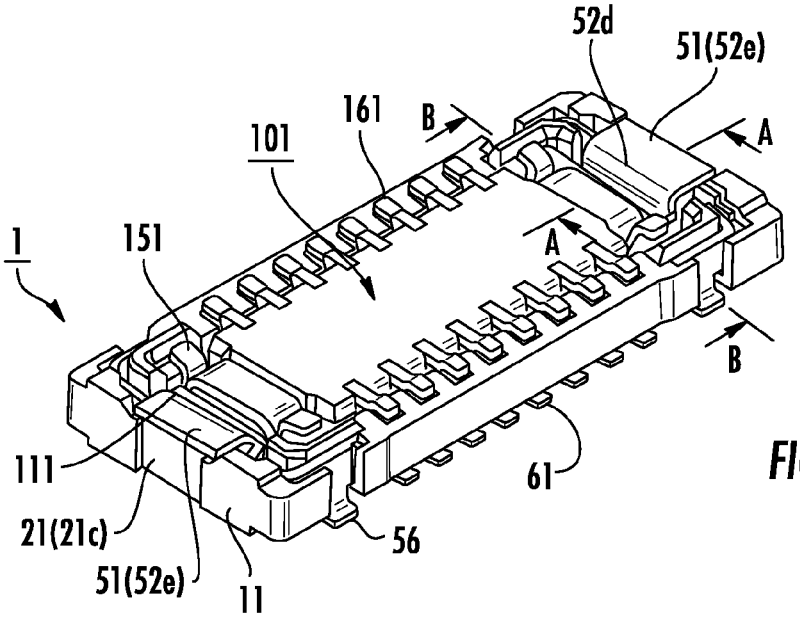
FIG. 2 is a perspective view of the mated first connector and second connector in the embodiment of the Present Disclosure, as viewed from the mating surface of the first connector.
Figure 3:
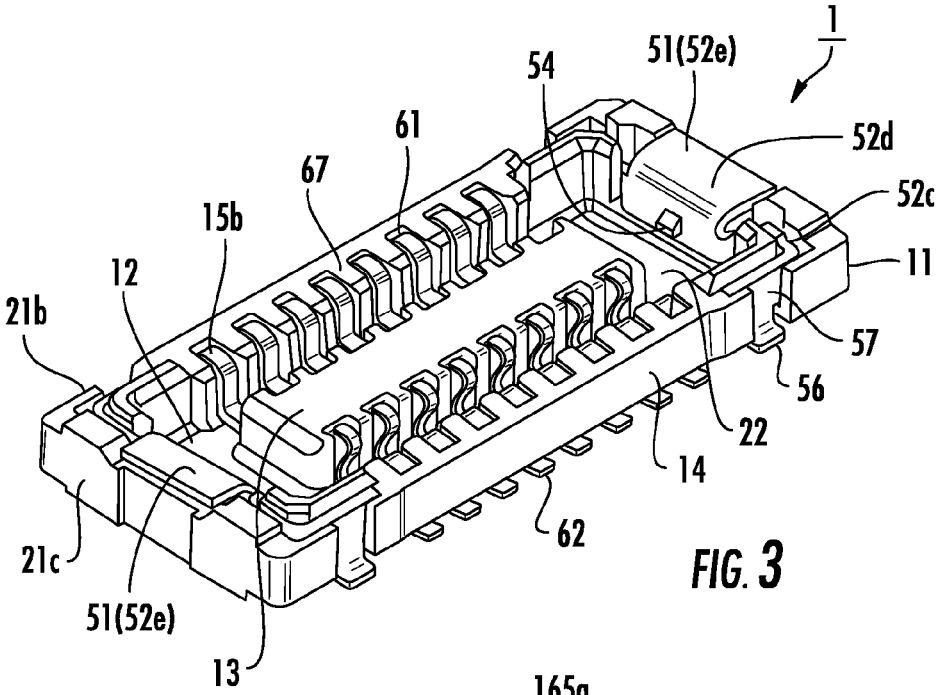
FIG. 3 is a perspective view of the first connector of FIG. 1.

Referring to FIGS. 1-3, 1 is the first connector which is one of the pair of board-to-board connectors. This is a surface mounted connector which is mounted on the surface of a first board (not shown). Also, 101 is the second connector which is the other one of the pair of board-to-board connectors. This is also a surface mounted connector and is mounted on the surface of a second board (not shown). The board-to-board connectors in this embodiment include the first connector 1 and the second connector 101, and establish an electrical connection between the first board and the second board.

The first connector 1 has a first housing 11, which is an integrally molded connector main body made of an insulating material. As shown in the Figures, the first housing 11 has a rectangular thick plate-like shape, and has a rectangular recessed portion 12 with a surrounded perimeter formed on the side receiving the inserted second connector 101; that is, the mated surface (the upper surface in FIG. 3). A first protruding portion 13 is integrally formed inside the recessed portion 12 of the first housing 11 as an island. Side wall portions 14 are integrally formed with the first housing 11 and extend parallel to the first protruding portion 13 on both sides of the first protruding portion 13. Here, the first protruding portion 13 and the side wall portions 14 protrude upward from the bottom surface of the recessed portion 12, and extend in the longitudinal direction of the first housing 11. A recessed groove portion 12*a* is formed as a portion of the recessed portion 12 on both ends of the first protruding portion 13 between the first protruding portion 13 and the side wall portion 14. These slender recessed portions extend in the longitudinal direction of the first housing 11. In the example shown in the Figures, there is only a single first protruding portion 13; however, there may be one or more of these protruding portions.

Here, a groove-shaped first terminal accommodating inner cavity 15*a* is formed on both side surfaces of the first protruding portion 13. A groove-shaped first terminal accommodating inner cavity 15*a* is also formed on both inside surfaces of the side wall portions 14. The first terminal accommodating inner cavity 15*a* and first terminal accommodating outer cavity 15*b* are connected to and integrated with the bottom surface of the recessed groove portion 12*a*. When the first terminal accommodating inner cavity 15*a* and the first terminal accommodating outer cavity 15*b* are explained collectively, they will be referred to simply as the first terminal accommodating cavities 15. Eight first terminal accommodating cavities 15 are formed on both sides of the first protruding portion 13 at a predetermined pitch. There are eight first terminals 61 provided on both sides of the first protruding portion 13 at a predetermined pitch, which are accommodated in each of the first terminal accommodating cavities 15.

Each first terminal 61 is an integrally formed conductive metal plate which is stamped and bent, and has a held portion 63, a tail portion 62 connected to the bottom end of the held portion 63, an upper connecting portion 67 connected to the upper end of the held portion 63, a second contact portion 66 formed near the end of the upper connecting portion 67 on the inside, a lower connecting portion 64 connected to the second contact portion 66, and a first contact portion 65 formed near the free end of the lower connecting portion 64. The held portion 63 extends vertically; that is, in the thickness direction of the first housing 11, and is inserted into and held by the first terminal accommodating outer cavity 15*b*. The tail portion 62 is bent towards and connected to the held portion 63, extends laterally; that is, outward in the width direction of the first housing 11, and is connected using solder to a connection pad linked to a conductive trace on the first board. The upper connecting portion 67 is bent towards and connected to the held portion 63, and extends inward in the width direction of the first housing 11.

A second contact portion 66 is formed on the inner end of the upper connecting portion 67, bends downward, and is curved so as to protrude inward in the width direction of the first housing 11. The lower connecting portion 64 has a U-shaped side surface profile and is connected to the bottom end of the second contact portion 66. A first contact portion 65 formed on the free end of the lower connecting portion 64 near the upper end on the inside is bent into a U-shape, and is curved so as to protrude outward in the width direction of the first housing 11.

The first terminal 61 is inserted into the first terminal accommodating cavity 15 from the mounting surface side (the bottom side in FIG. 3), and the held portion 63 is interposed on both sides between the side walls of the first terminal accommodating outer cavity 15*b* formed on the inside surface of the side wall portion 14 to secure the terminal in the first housing 11. In this state, the first terminal 61 is loaded inside the first housing 11 with the first contact portion 65 and the second contact portion 66 positioned facing the left and right sides of the recessed groove portion 12*a*.

The first terminal 61 is integrally formed by bending a metal plate, and has a certain degree of elasticity. As should be clear from the shape, the interval between the first contact portion 65 and the second contact portion 66 facing each other is elastically deformable. In other words, when a second terminal 161 on the second connector 101 is inserted between the first contact portion 65 and the second contact portion 66, the interval between the first contact portion 65 and the second contact portion 66 is expanded elastically.

A first protruding end portion 21 is arranged as a first mating guide portion on both ends of the first housing 11 in the longitudinal direction. A protruding end recessed portion 22 is formed as a section of the recessed portion 12 in each of the first protruding end portions 21. The protruding end recessed portions 22 are rectangular recessed portions, and connect to both ends of the recessed groove portions 12*a* in the longitudinal direction. When the first connector 1 and the second connector 101 are mated, the protruding end recessed portions 22 function as insertion recessed portions into which a second protruding end portion 122 on the second connector 101 explained below has been inserted.

The first protruding end portions 21 have a side wall extending portion 21*b* extending in the longitudinal direction of the first housing 11 from both longitudinal ends of the side wall portion 14, and an outer wall portion 21*c* extending in the lateral direction of the first housing 11 and connected at both ends to the side wall extending portion 21*b*. In each first protruding end portion 21, a continuous C-shaped side wall is formed with the outer wall portion 21*c* and the side wall extending portions 21*b* connected to both ends to define three sides of the rectangular protruding end recessed portion 22.

A first reinforcing bracket 51 is mounted on the first protruding end portion 21 to serve as a reinforcing bracket. The first reinforcing bracket 51 is arranged on the protruding end recessed portion 22 outward in the longitudinal direction of the first housing 11, and is accommodated and held inside a first bracket holding recessed portion 26 formed on the first protruding end portion 21. In the present embodiment, the first reinforcing bracket 51 includes a band-like first main body portion 52, integrally formed by stamping and bending a metal plate and extending entirely in the width direction of the first housing 11; a first arm portion 57, bent and connected to both the left and the right ends of the first main body portion 52, and extending in the longitudinal direction of the first housing 11, and held in the first housing 11; a first board connecting portion 56 connected to the bottom end of the first arm portion 57; and a first locking portion 54 formed in the first main body portion 52.

The first main body 52 includes a central portion 52*a*, extending linearly in the lateral direction of the first housing 11 when viewed from direction of first connector 1 and second connector 101 insertion and extraction—that is, when viewed from the vertical direction; bent portions 52*b*, connected to both ends of the central portion 52*a*, and bent into a crank-shape when viewed from the vertical direction; outer end portions 52*c*, extending linearly in the width direction of the first housing 11 when viewed from the vertical direction, and extending from the bent portions 52*b* in the lateral direction of the first housing 11; and a cover portion 52*e*, extending to the outside in the axial direction of the first housing 11 so as to run across the upper end of the central portion 52*a* and orthogonal to the central portion 52*a* via a rounded portion 52*d* to cover the outer wall portion 21*c* of the first protruding end portions 21 from above. In the example shown in the Figures, the bent portions 52*b* are bent so that the central portion 52*a* is positioned closer to the middle than the outer end portions 52*c* in the longitudinal direction of the first housing 11. However, they may be bent so that the outer end portions 52*c* are positioned closer to the middle than the central portion 52*a* in the longitudinal direction of the first housing 11. Also, as shown, the cover portion 52*e* covers the middle section of the outer wall portion 21*c* from above. However, it may also cover the entire outer wall portion 21*c* from above.

In the example shown in the Figures, a single first locking portion 54 is formed in the central portion 52*a*. However, more than one first locking portion 52 may be formed. The position of the first locking portions 54 may be freely determined. However, typically, they are arranged symmetrically to the right and left of the central axis in the lateral direction of the first housing 11. In other words, when there is an odd number of first locking portions 54, one is arranged on the central axis in the lateral direction of the first housing 11, and an even number of first locking portions is arranged symmetrically to the left and to the right of the central line. When there is an odd number of first locking portions 54, an even number of first locking portions is arranged symmetrically to the left and to the right of the central line. In the example shown in the Figures, the first locking portion 54 is a protruding portions protruding from the surface of the central portion 52*a*. However, the first protruding portions may have any shape able to engage the second locking portion 154 described below. They do not have to be protruding portions. For example, when the second locking portion 154 is a protruding portion, it may be a recessed portion or opening able to engage this protruding portion. Here, for the sake of explanatory simplicity, the first locking portion 54 is a single protruding portion arranged on the central axis in the lateral direction of the first housing 11.

A first arm portion 57 extends from the outer end of the outer end portion 52*c* towards the center in the longitudinal direction of the first housing 11. An uneven first locking portion 57*a* is formed on the free end, and a protruding portion 57*b* is formed on the inner surface. The free end of the first board connecting portion 56 is bent outward in the lateral direction of the first housing 11 and connected to the bottom end of the first arm portion 57. The first board connecting portion 56 functions as a tail portion soldered to the first reinforcing bracket 51, the bottom surface is formed so as to be substantially parallel to the mounting surface (not shown) of the first housing 11, and is secured using, for example, solder to an anchoring pad on the first board.

The first bracket holding recessed portion 26 includes a band-like outer end accommodating portion 26*a*, extending in the thickness direction and width direction of the first housing 11; a groove-like first arm accommodating portion 26*b*, formed in the side wall extending portion 21*b* so as to extend in the thickness direction and width direction of the first housing 11 and connect to the outer end accommodating portion 26*a*; a first locked portion 26*c*, arranged on the end of the arm accommodating portion 26*c* closer to the center in the longitudinal direction of the first housing 11 to be locked by the first locking portion 57*a*; and a connecting portion accommodating opening 26*d*, connected to the first arm accommodating portion 26*b* and open in the outer surface of the side wall extending portion 21*b* so that the first board connecting portion 56 is visible from the outside.

When it has been attached to the first protruding end portion 21, the first reinforcing bracket 51 is nearly accommodated in its entirety inside the first bracket holding recessed portion 26. However, the surface of the central portion 52*a* of the first main body portion 52 close to the center in the longitudinal direction of the first housing 11 is exposed along with the first locking portion 54 in the protruding end recessed portion 22, and the first board connecting portion 56 and the section of the first arm portion 57 positioned above the first board connecting portion 56 are exposed in the connecting portion accommodating opening 26*d*. The protruding portion 57*b* formed on the inner surface of the first arm portion 57 makes contact with (pressing against, engaging, etc.) the side surface of the first housing 11 inside the first arm accommodating portion 26*b*, increasing the integration of the first reinforcing bracket 51 and the first housing 11.

Figure 4:
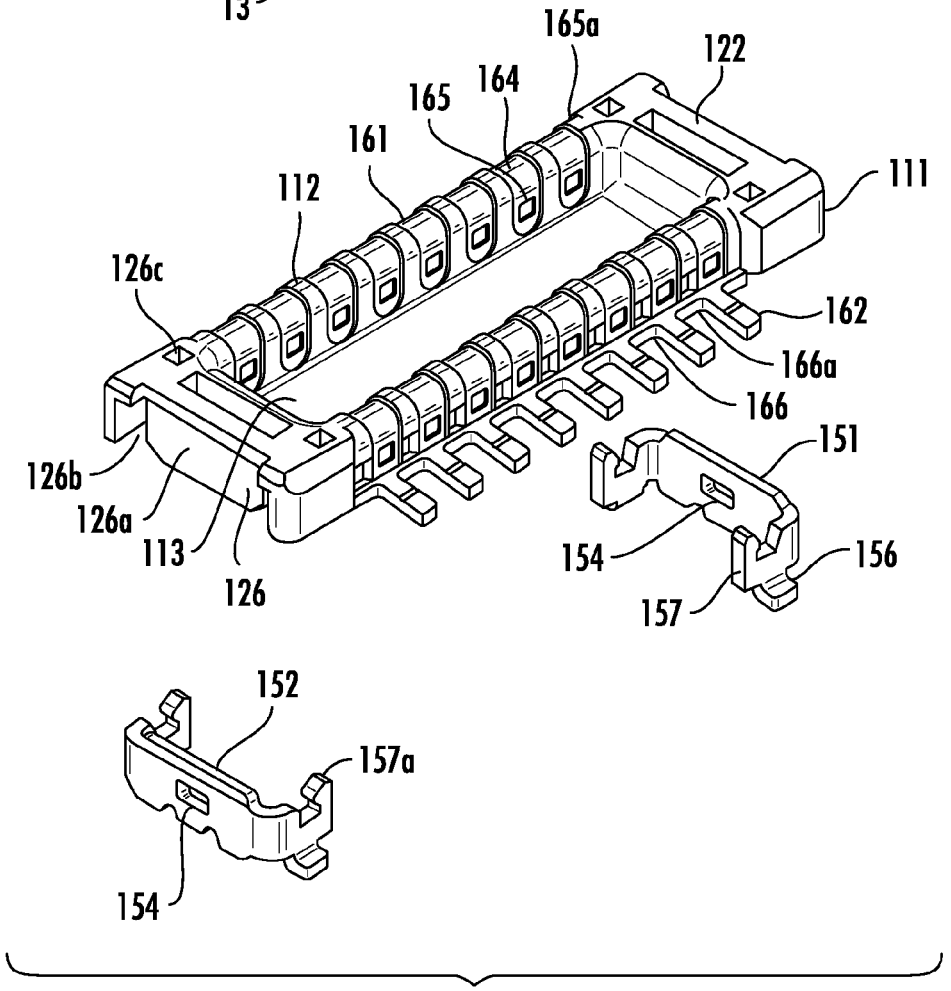
FIG. 4 is an exploded perspective view of the second connector of FIG. 2, as viewed from the mating surface.
Figure 5:
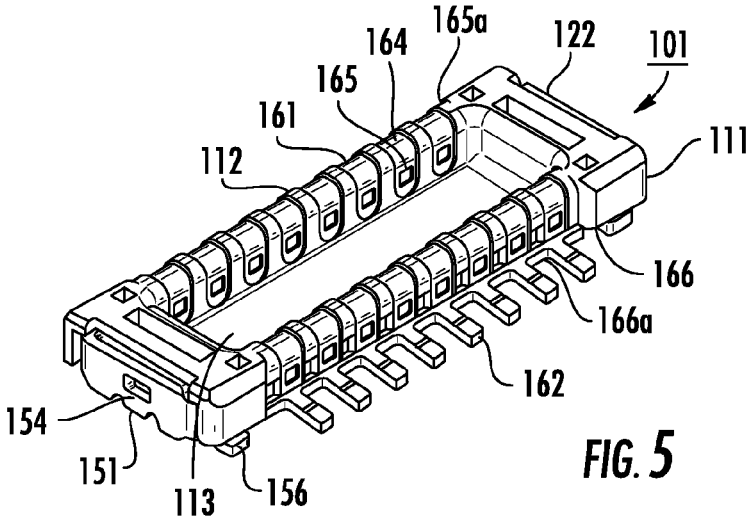
FIG. 5 is a perspective view of the second connector of FIG. 4.

Referring to FIGS. 4-5, the second connector 101 has a second housing 111, which is an integrally molded connector main body made of an insulating material. As shown in the Figures, the second housing 111 has a rectangular thick plate-like shape. The second connector 111 includes an integrally formed slender recessed groove portion 113 extending in the longitudinal direction of the second housing 111 on the side mated with the first connector 1; that is, in the mated surface side (the upper side in the drawings), and second protruding portions 112 serving as slender protruding portions, which define the outside of the recessed groove portion 113 and extend in the longitudinal direction of the second housing 111. The second protruding portions 112 extend along both sides of the recessed groove portion 113 and along both sides of the second housing 111. A second terminal 161 is arranged on each second protruding portion 112. As shown in the Figures, the bottom portion of the recessed groove portion 113 closes the side mounted on the second board; that is, the mounting surface (the bottom surface in the drawing). In the example shown in the Figures, there are two second protruding portions 112, but one or more may be used.

Each second terminal 161 is an integrally formed conductive metal plate which has been stamped and bent, and has a main body (not shown), a tail portion 162 connected to the bottom end of the main body portion, a first contact portion 165 connected to the upper end of the main body portion, a connecting portion 164 connected to the upper end of the first contact portion 165, and a second contact portion 166 connected to the outside end of the connecting portion 164. A first contact recessed portion 165*a* is formed on the surface of the first contact portion 165 to engage the first contact portion 65 of a first terminal 61, and a second contact recessed portion 166*a* is formed on the surface of the second contact portion 166 to engage the second contact portion 66 of a first terminal 61.

The main body portion, while not shown in FIGS. 4-5, surrounds the periphery and is held by the second housing 111. The tail portion 162 is connected at the bottom end extending in the lateral direction of the main body portion; that is, in the lateral direction of the second housing 111, extends outward from the second housing 111, and is connected, for example, using solder, to a connection pad connected to a conductive trace on the second board. The first contact portion 165 is flat and plate-shaped, is connected to the main body portion, and extends vertically; that is, in the thickness direction of the second housing 111. The connecting portion 164 is bent and connected to the first contact portion 165, and extends outward in the lateral direction of the second housing 111. The second contact portion 166 is bent and extends downward, and is connected to the outer end of the connecting portion 164.

Each second terminal 161 is integrated with the second housing 111 using overmolding. In other words, the second housing 111 is molded by filling a mold cavity in which the second terminals 161 have been set with a resin. This embeds the main body portion of each second terminal 161 in the second housing 111, and integrally mounts the terminal in the second housing 111 so that the surfaces of the first contact portion 165, the connecting portion 164, and the second contact portion 166 are exposed on the side surfaces of the second protruding portions 112 and on the mounting surface. Here, there are sixteen second terminals 161 arranged at a predetermined pitch.

A second protruding end portion 122 is arranged as a second mating guide portion on both ends of the second housing 111 in the longitudinal direction. Each thick second protruding end portion 122 extends in the lateral direction of the second housing 111 and both ends are connected to both ends of each second protruding portion 112 in the longitudinal direction. The upper surface has a substantially rectangular shape. When the first connector 1 and the second connector 101 have been mated, the second protruding end portion 122 function as an insertion protruding portion which has been inserted into the protruding end recessed portion 22 of the first protruding portion 21 on the first connector 1.

A second reinforcing bracket 151 is mounted as a reinforcing bracket on the second protruding end portion 122. The second reinforcing bracket 151 is arranged along the outer end of the second protruding end portion 122 in the longitudinal direction of the second protruding end portion 122, and is accommodated by and held inside a second bracket holding recessed portion 126 formed in the second protruding end portion 122. In the present embodiment, the second reinforcing bracket 151 is integrally formed by stamping and bending a metal plate, and includes a slender band-like second main body portion 152, which extends entirely in the width direction of the second housing 111; a second arm portion 157, which is bent and connected to both the left and the right ends of the second main body portion 152, extends in the longitudinal direction of the second housing 111, and is held in the second housing 111; a second board connecting portion 156 connected to the bottom end of the second arm portion 157; and a second locking portion 154 formed in the second main body portion 152.

In the example shown in the Figures, a single second locking portion 154 is formed in the second main body portion 152. However, more than one second locking portion 154 may be formed. This is determined by the number of first locking portions 54 on the first reinforcing bracket 51. The arrangement of the second locking portions 154 is also determined by the arrangement of first locking portions 54. Typically, they are arranged symmetrically to the right and left of the central axis in the lateral direction of the second housing 111. In the example shown, a second locking portion 154 is an opening passing through the second main body portion 152 in the thickness direction. It may also be a recess formed in the surface of the second main body portion 152. In other words, it does not have to be an opening as long as it has a shape that can be engaged by a first locking portion 54. For example, when the first locking portion 54 is a recess or opening, it may be a protruding portion that engages the recess or opening. Here, for the sake of explanatory simplicity, the second locking portion 154 is a single opening arranged on the central axis in the lateral direction of the second housing 111.

A second arm portion 157 extends inward from both the left and right ends of the second main body portion 152 in the longitudinal direction of the second housing 111, and a second locking portion 157*a* extending upward is provided on the free end. The second base connecting portion 156 is connected to the bottom end of the second arm portion 157 and the free end is bent so as to face outward in the lateral direction of the second housing 111. The second board connecting portion 156 functions as a tail portion soldered to the second reinforcing bracket 151, the bottom surface is formed so as to be substantially parallel to the mounting surface (not shown) of the second housing 111, and is secured to an anchoring pad on the second board.

The second bracket holding recessed portion 126 includes a second main body accommodating portion 126*a* extending in the thickness direction and width direction of the second housing 111 on the outer surface of the second protruding end portion 122 in the longitudinal direction of the second housing 111; a groove-like second arm accommodating portion 126*b* extending in the thickness direction and the length direction of the second housing 111, and formed so as to connect to both ends of the second main body accommodating portion 126*a*; and a second locked portion 126*c* arranged closer to the center than the second arm accommodating portion 126*b* in the longitudinal direction of the second housing 111, extending upward, opening on the top end on the upper surface of the second protruding end portion 122, and being locked by the second locking portion 157*a*.

When it has been attached to the second protruding end portion 151, the second reinforcing bracket 151 is nearly accommodated in its entirety inside the second bracket holding recessed portion 126. However, the surface of the second main body portion 152 in the longitudinal direction of the second housing 111 is exposed along with the second locking portion 154 in the second protruding end recessed portion 122, and the bottom surface of the second board connecting portion 156 is exposed on the mounting surface of the second housing 111. When the first connector 1 and the second connector 101 have been mated, the second locking portion 154 engages a first locking portion 54 on the first reinforcing bracket 51 of the first connector 1.

Figure 6A:
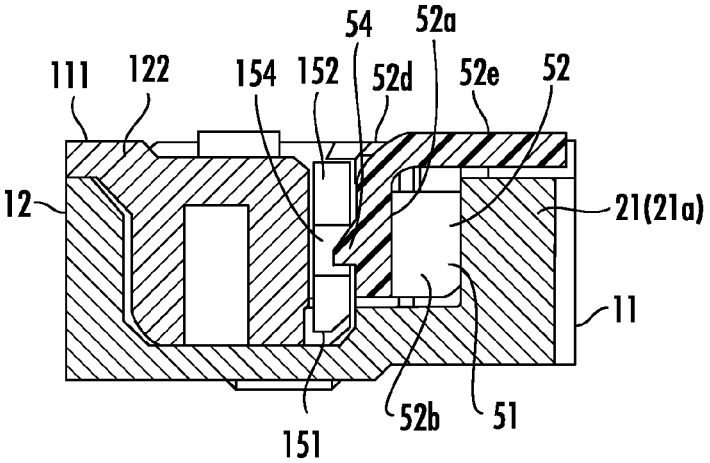
FIG. 6 is a first cross-sectional view of the connectors showing the reinforcing brackets in the embodiment of the Present Disclosure in which the cross-sectional view is taken from Arrow A-A in FIG. 2, in which FIG. 6(*a*) shows the normal situation and FIG. 6(*b*) shows the situation in which disengaging force has been applied.
Figure 6B:
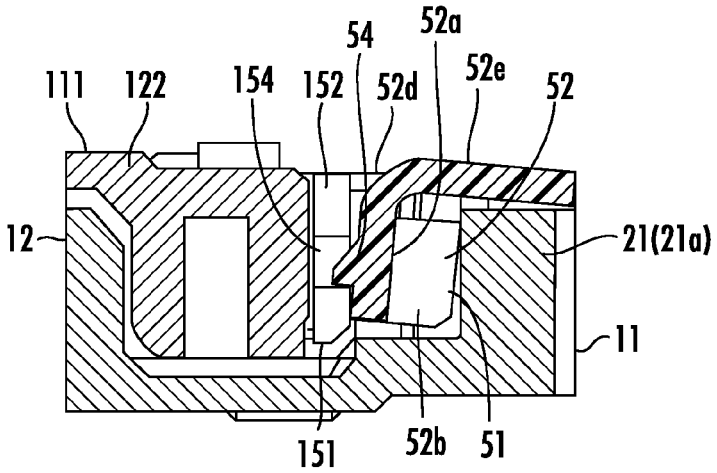
Figure 7:
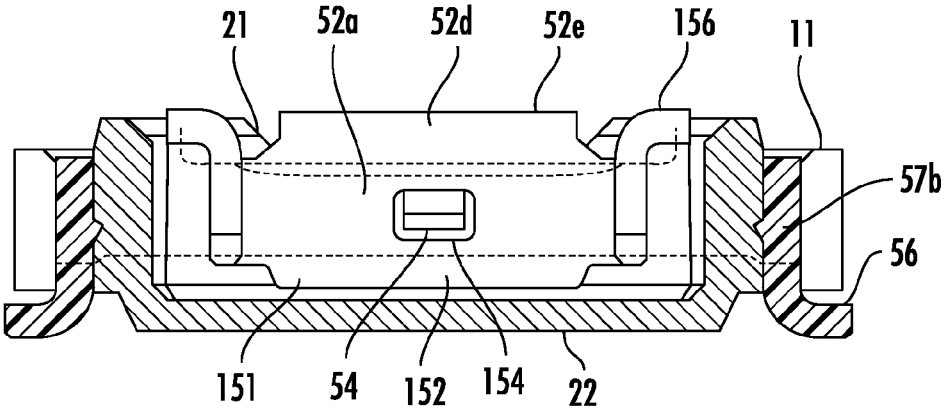
FIG. 7 is a second cross-sectional view of the connectors showing the reinforcing brackets in the embodiment of the Present Disclosure in which the cross-sectional view is taken from Arrow B-B in FIG. 2.
Figure 8A:
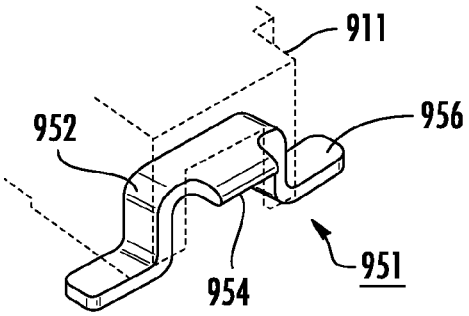
FIG. 8A Prior Art
FIGS. 8(*a*) and 8(*b*) are a perspective view showing conventional reinforcing brackets for board-to-board connectors.
Figure 8B:
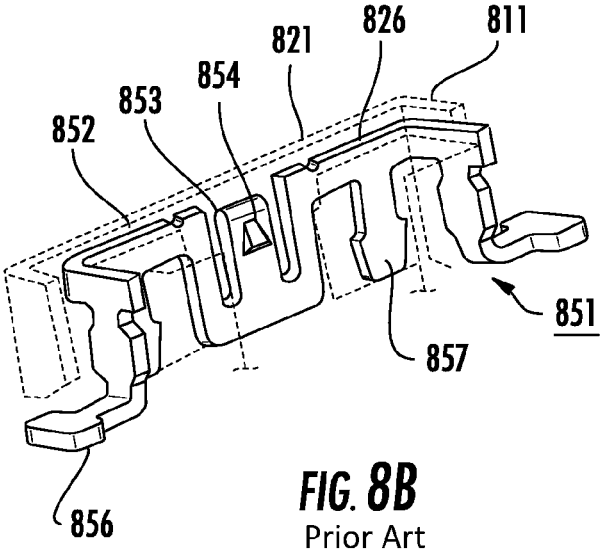
FIG. 8B Prior Art

Referring to FIGS. 6-7, which illustrate the mating of the first connector 1 and the second connector 101, the tail portions 62 of the first terminals 61 on the first connector 1 are connected using solder to connection pads connected to conductive traces on the first board (not shown), and the first board connecting portions 56 of the first reinforcing bracket 51 are connected using solder to anchoring pads on the first board and surface-mounted on the first board. Similarly, the tail portions 162 of the second terminals 161 on the second connector 101 are connected using solder to connection pads connected to conductive traces on the second board (not shown), and the second board connecting portions 156 of the second reinforcing bracket 151 are connected using solder to anchoring pads on the second board and surface-mounted on the second board.

First, the operator brings the mating surface of the first connector 1 towards the mating surface of the second connector 101, and positions the left and right second protruding portions 112 of the second connector 101 relative to the left and right recessed groove portions 12*a* of the first connector 1 to complete the alignment of the first connector 1 and the second connector 101. When the first connector 1 and/or the second connector 101 are moved towards each other in the mating direction, the left and right second protruding portions 112 on the second connector 101 are inserted into the left and right recessed groove portions 12*a* in the first connector 1.

When the first connector 1 and/or the second connector 101 are moved towards each other in the mating direction while misaligned in the longitudinal direction of the first housing 11, the second protruding end portion 122 of the second connector 101 comes close to the outer wall portion 21*c* of the first connector 1 but, because the outer wall portion 21*c* is covered by the cover portion 52*e* of the first reinforcing bracket 51, the second protruding end portion 122 of the second connector 101 avoids striking the outer wall portion 21*c* of the first connector 1, and the outer wall portion 21*c* is kept from becoming deformed or damaged. Also, the misaligned second protruding end portion 122 of the second connector 101 is guided by the cover portion 52*e* and the rounded portion 52*d* of the first reinforcing bracket 51 into the protruding end recessed portion 22 in the first connector 1, and the first connector 1 and the second connector 101 are smoothly mated.

When the left and right second protruding portions 112 of the second connector 101 are inserted into the left and right grooved recess portions 12*a* of the first connector 1, each second terminal 161 on the second connector 101 is inserted between the first contact portion 65 and the second contact portion 66 of a first terminal 61, the first contact portion 65 of the first terminal 61 comes into contact with the first contact portion 165 of the second terminal 161, and the second contact portion 66 of the first terminal 61 comes into contact with the second contact portion 166 of the second terminal 161.

When the first connector 1 and the second connector 101 have been mated as shown in FIG. 2, an electrical connection has been established between the first terminals 61 and the second terminals 161. More specifically, the first contact portion 65 of each first terminal 61 engages a first contact recessed portion 165*a* of a second terminal 161, and the second contact portion 66 of each first terminal 61 engages the second contact recessed portion 166*a* of a second terminal 161. As a result, an electrical connection is established between a conductive trace connected to a connection pad on the first board connected to the tail portion 62 of a first terminal 61 and a conductive trace connected to a connection pad on the second board connected to the tail portion 162 of a second terminal 161. Because contact is established between multiple first terminals 61 and second terminals 161, a reliable electrical connection can be maintained.

As shown in FIGS. 6-7, the first reinforcing bracket 51 of the first connector 1 engages the second reinforcing bracket 151 of the second connector 101, and the brackets are locked. Here, the first locking portion 54 of the first reinforcing bracket 51, which is a protruding portion, is inserted into the second locking portion 154 of the second reinforcing bracket 151, which is an opening, the first locking portion 54 engages the second locking portion 154, and the first connector 1 and the second connector 101 are locked.

When disengaging force is applied to the mated first connector 1 and second connector 101, that is, when force is applied to disconnect the second connector 101 from the first connector 1, the second connector 101 does not readily disconnect from the first connector 1. In other words, the disengaging force has to be increased.

When this disengaging force is applied to the first reinforcing bracket 51 and the second reinforcing bracket 151, torsion is applied to the first main body portion 52 of the first reinforcing bracket 51 as shown in FIG. 6(*b*). In contrast, when disengaging force is applied as shown in FIG. 6(*a*), the second reinforcing bracket 151 rises relative to the first reinforcing bracket 51, upwardly displacing the first locking portion 54 engaged with the second locking portion 154, and causing the first main body portion 52 to undergo torsional moment.

When the disengaging force is increased, the amount of torsional distortion of the first main body portion 52 increases, and the first locking portion 54 and the second locking portion 154 become disengaged. As a result, the first connector 1 and the second connector 101 become unlocked, and the first connector 1 and the second connector 101 are unmated.

However, in the present embodiment, the first main body portion 52 includes bent portions 52*b* which are bent into a crank-shape when viewed from the direction of insertion and detachment for the first connector 1 and the second connector 101, and a cover portion 52*e* which is bent towards the upper end of the central portion 52*a*. More specifically, the crank-shaped bent portions 52*b* are connected to both sides of the central portion 52*a* formed by the first locking portion 54, and the cover portion 52*e*, which extends outward in the axial direction of the first housing 11, is connected to the upper end of the central portion 52*a*. Because the first main body portion 52 has a high sectional modulus and high torsional rigidity, torsional deformation is unlikely to occur. Therefore, even when the first main body portion 52 undergoes torsional moment, the amount of torsional deformation of the first main body portion 52 is small, and the first locking portion 54 and the second locking portion 154 do not disengage. In other words, the pair of bent portions 52*b* and the cover portion 52*e* have a synergistic effect which increases the torsional rigidity of the first main body portion 52. This increases the required disengaging force, and makes it more difficult to detach the second connector 101 from the first connector 1.

As in the case of the first main body portion 52 of the first reinforcing bracket 51, the second main body portion 152 of the second reinforcing bracket 151 also undergoes torsional moment. However, the dimensions of the second main body portion 152 are smaller than those of the first main body portion 52 relative to the lateral direction of the second housing 111. Therefore, even though it undergoes the same degree of torsional moment, the amount of torsional deformation of the second main body portion 152 is small. In the present embodiment, the crank-shaped sections of the bent portions 52*b* are not formed in the second main body portion 152. However, the crank-shaped sections of the bent portions 52*b* can be formed in the second main body portion 152 if the amount of torsional deformation of the second main body portion 152 has to be smaller.

The first reinforcing bracket 51 and the second reinforcing bracket 151 can be used as ground terminals. Here, the first board connecting portion 56 of the first reinforcing bracket 51 is connected using solder to a connection pad linked to the ground line of the first board, and the second board connecting portion 156 of the second reinforcing bracket 151 is connected using solder to a connection pad linked to the ground line of the second board.

In the present embodiment, a pair of bent portions 52*b* and a cover portion 52*e* are formed in the first reinforcing bracket 51 of the first connector 1, and the synergy of the pair of bent portions 52*b* and the cover portion 52*e* can effectively prevent deformation of the first reinforcing bracket 51. As a result, the first reinforcing bracket 51 of the first connector 1 and the second reinforcing bracket 151 of the second connector 101 are more securely engaged and locked, and a stronger disengaging force is required. As a result, the first connector 1 and the second connector 101 remain reliably mated.

However, the cover portion 52*e* of the first reinforcing bracket 51 covers the outer wall portion 21*c* of the connector 1, which keeps a misaligned second protruding end portion 122 on the second connector 101 from striking the outer wall portion 21*c* of the first connector 1, and this prevents deformation of and damage to the outer wall portion 21*c*. The misaligned second protruding end portion 122 on the second connector 101 is guided by the cover portion 52*e* and the rounded portion 52*d* of the first reinforcing bracket 51 into the protruding end recessed portion 22 of the first connector 1 to be able to smoothly mate the first connector 1 with the second connector 101.

While a preferred embodiment of the Present Disclosure is shown and described, it is envisioned that those skilled in the art may devise various modifications without departing from the spirit and scope of the foregoing Description and the appended Claims.

What is claimed is:

1. A board-to-board connector assembly, the board-to-board connector assembly comprising:

a first connector, the first connector having a first housing, a first terminal and a first reinforcing bracket, the first housing being substantially rectangular in configuration, the first housing having an insertion recessed portion and a protruding end portion, the protruding end portion having a holding recessed portion, the first reinforcing bracket being substantially disposed in the holding recessed portion; and a second connector, the second connector having a second housing, a second terminal and a second reinforcing bracket, the second housing being substantially rectangular in configuration, the second housing having an insertion protruding portion;

wherein, when the first connector and the second connector are connected to each other, the second terminal contacts the first terminal, the insertion protruding portion and the second reinforcing bracket are positioned within the insertion recessed portion, and the second reinforcing bracket is engaged with first reinforcing bracket; and wherein:

the first reinforcing bracket includes a band-like first main body portion and a first arm portion, the first main body portion extending in the lateral direction of the first housing, the first arm portion being connected to both ends of the first main body portion, extending in the longitudinal direction of the first housing and being held by the first housing;

the first main body includes a central portion, a pair of bent portions, a pair of outer end portions, a first locking portion and a cover portion, the central portion extending linearly in the lateral direction of the first housing when viewed from the direction of insertion and extraction, the bent portions being connected to both ends of the central portion and formed in a crank-shape when viewed from the direction of insertion and extraction to increase both the section modulus and the torsional stiffness, the outer end portions extending from the bent portions in the lateral direction of the first housing and being connected to the first arm portion, the first locking portion being formed in the central portion, the cover portion extending to the outside in the axial direction of the first housing so as to run across the upper end of the central portion and orthogonal to the central portion to increase the torsional stiffness of the central portion and protect an outer wall portion of the protruding end portion;

the second reinforcing bracket includes a band-like second main body portion and a second locking portion, the second main body portion extending in the lateral direction of the second housing, the second locking portion being formed in the second main body portion;

the first locking portion is a protruding portion formed in the central portion and protrudes towards the second reinforcing bracket; and the second locking portion is a recessed or an open portion engaging the first locking portion.

2. The board-to-board connector assembly of claim 1, wherein the first arm portion includes a protruding portion.

3. The board-to-board connector assembly of claim 2, wherein the protruding portion of the first arm portion is provided on an inside surface thereof.

4. The board-to-board connector assembly of claim 3, wherein the protruding portion of the first arm portion is in contact with a side surface of the first housing.

5. The board-to-board connector assembly of claim 1, wherein the insertion recessed portion is formed at an end of the first housing in the longitudinal direction.

6. The board-to-board connector assembly of claim 5, wherein the first reinforcing bracket is disposed towards the outside in the longitudinal direction of the insertion recessed portion.

7. The board-to-board connector assembly of claim 6, wherein the insertion protruding portion is formed at an end of the second housing in the longitudinal direction.

8. The board-to-board connector assembly of claim 7, wherein the second reinforcing bracket is disposed along the outside end of the insertion protruding portion in the longitudinal direction.

9. A board-to-board connector assembly, the board-to-board connector assembly comprising:

a first connector, the first connector having a first housing, a first terminal and first and second reinforcing brackets, the first housing being substantially rectangular in configuration, the first housing having first and second opposite insertion recessed portions and first and second opposite protruding end portions, the first protruding end portion having a first holding recessed portion, the second protruding end portion having a second holding recessed portion, the first reinforcing bracket being substantially disposed in the first holding recessed portion, the second reinforcing bracket being substantially disposed in the second holding recessed portion; and a second connector, the second connector having a second housing, a second terminal and third and fourth reinforcing brackets, the second housing being substantially rectangular in configuration, the second housing having first and second opposite insertion protruding portions;

wherein, when the first connector and the second connector are connected to each other, the second terminal contacts the first terminal, the first insertion protruding portion and the third reinforcing bracket are positioned within the first insertion recessed portion, the second insertion protruding portion and the fourth reinforcing bracket are positioned within the second insertion recessed portion, the third reinforcing bracket is engaged with the first reinforcing bracket, and the fourth reinforcing bracket is engaged with second reinforcing bracket; and wherein:

each of the first and second reinforcing brackets include a band-like first main body portion and a first arm portion, the first main body portion extending in the lateral direction of the first housing, the first arm portion being connected to both ends of the first main body portion, extending in the longitudinal direction of the first housing and being held by the first housing;

the first main body includes a central portion, a pair of bent portions, a pair of outer end portions, a first locking portion and a cover portion, the central portion extending linearly in the lateral direction of the first housing when viewed from the direction of insertion and extraction, the bent portions being connected to both ends of the central portion and formed in a crank-shape when viewed from the direction of insertion and extraction to increase both the section modulus and the torsional stiffness, the outer end portions extending from the bent portions in the lateral direction of the first housing and being connected to the first arm portion, the first locking portion being formed in the central portion, the cover portion extending to the outside in the axial direction of the first housing so as to run across the upper end of the central portion and orthogonal to the central portion to increase the torsional stiffness of the central portion and protect an outer wall portion of the respective protruding end portion;

each of the third and fourth reinforcing brackets include a band-like second main body portion and a second locking portion, the second main body portion extending in the lateral direction of the second housing, the second locking portion being formed in the second main body portion;

the first locking portion of each of the first and second reinforcing brackets is a protruding portion formed in the central portion and protrudes towards the third and fourth reinforcing brackets, respectively; and the second locking portion of each of the third and fourth reinforcing brackets is a recessed or an open portion engaging the first locking portion of the first and second reinforcing brackets, respectively.

10. The board-to-board connector assembly of claim 9, wherein the first and second insertion recessed portions are formed at opposite ends of the first housing in the longitudinal direction.

11. The board-to-board connector assembly of claim 10, wherein the first reinforcing bracket is disposed towards the outside in the longitudinal direction of the first insertion recessed portion, and wherein the second reinforcing bracket is disposed towards the outside in the longitudinal direction of the second insertion recessed portion.

12. The board-to-board connector assembly of claim 11, wherein the first and second insertion protruding portions are formed at opposite ends of the second housing in the longitudinal direction.

13. The board-to-board connector assembly of claim 12, wherein the third reinforcing bracket is disposed along the outside end of the first insertion protruding portion in the longitudinal direction, and wherein the fourth reinforcing bracket is disposed along the outside end of the second insertion protruding portion in the longitudinal direction.

14. The board-to-board connector assembly of claim 9, wherein the first arm portion of each of the first and second reinforcing brackets includes a protruding portion.

15. The board-to-board connector assembly of claim 14, wherein the protruding portion of the first arm portion is provided on an inside surface thereof.

16. The board-to-board connector assembly of claim 15, wherein the protruding portion of the first arm portion is in contact with a side surface of the first housing.

* * * * *